US009612564B2

(12) United States Patent
Makiura et al.

(10) Patent No.: US 9,612,564 B2
(45) Date of Patent: Apr. 4, 2017

(54) SUPPORT MEMBER, IMAGE CARRIER, AND IMAGE FORMING APPARATUS

(71) Applicant: FUJI XEROX CO., LTD., Tokyo (JP)

(72) Inventors: Shinya Makiura, Kanagawa (JP); Hiroshi No, Kanagawa (JP); Masahiro Mori, Kanagawa (JP); Shuhei Yamazaki, Kanagawa (JP); Kazushi Arake, Kanagawa (JP); Satoshi Hayasaka, Kanagawa (JP)

(73) Assignee: FUJI XEROX CO. LTD., Tokyo (JP)

( * ) Notice: Subject to any disclaimer, the term of this patent is extended or adjusted under 35 U.S.C. 154(b) by 0 days.

(21) Appl. No.: 14/831,315

(22) Filed: Aug. 20, 2015

(65) Prior Publication Data

US 2016/0274532 A1 Sep. 22, 2016

(30) Foreign Application Priority Data

Mar. 16, 2015 (JP) ..... 2015-052373

(51) Int. Cl.
*G03G 15/00* (2006.01)
*G03G 15/10* (2006.01)

(52) U.S. Cl.
CPC ..... *G03G 15/751* (2013.01); *G03G 15/10* (2013.01)

(58) Field of Classification Search
CPC ..... G03G 15/751; G03G 21/1671; G03G 2215/00957; G03G 2215/00962; G03G 2221/1606; G03G 5/10; G03G 5/102; G03G 5/104
USPC ..... 399/117, 159
See application file for complete search history.

(56) References Cited

U.S. PATENT DOCUMENTS 5,430,526 A * 7/1995 Ohkubo ..... G03G 15/0233 399/159
5,722,016 A * 2/1998 Godlove ..... G03G 15/751 399/159
5,960,236 A * 9/1999 Zaman ..... G03G 5/10 399/109
6,438,338 B1 * 8/2002 Mark ..... G03G 15/751 399/159

(Continued)

FOREIGN PATENT DOCUMENTS

JP 60218685 A * 11/1985
JP 61038963 A * 2/1986

(Continued)

*Primary Examiner* — Robert Beatty
(74) *Attorney, Agent, or Firm* — Sughrue Mion, PLLC

(57) ABSTRACT

A support member supported in a cylinder includes six or more contact portions that are in contact with an inner peripheral surface of the cylinder. The support member is arc-shaped and has a gap extending in an axial direction of the cylinder. When the support member is viewed in the axial direction, a groove is formed in the support member such that the groove and the gap are on opposite sides of a center of the cylinder, and the contact portions are symmetrical with respect to a straight line that passes through the centers of the gap and the cylinder. Of the contact portions on one side of the straight line, the farthest contact portions are separated from each other by approximately 90 degrees or more, and the adjacent contact portions are separated from each other by approximately 20 degrees or more in the circumferential direction.

6 Claims, 17 Drawing Sheets

(56) References Cited

U.S. PATENT DOCUMENTS

| | | | | |
|---|---|---|---|---|
| 6,470,158 | B2 * | 10/2002 | Fritz | G03G 15/751 399/159 |
| 6,754,462 | B2 * | 6/2004 | Fujishiro | G03G 15/751 399/159 |
| 9,335,706 | B2 * | 5/2016 | Iikura | G03G 15/751 |

FOREIGN PATENT DOCUMENTS

| | | | | |
|---|---|---|---|---|
| JP | 05158387 | A | * | 6/1993 |
| JP | 08-054804 | A | | 2/1996 |
| JP | 2004246318 | A | * | 9/2004 |
| JP | 2005-004005 | A | | 1/2005 |
| JP | 2005025134 | A | * | 1/2005 |

* cited by examiner

SUPPORT MEMBER, IMAGE CARRIER, AND IMAGE FORMING APPARATUS

CROSS-REFERENCE TO RELATED APPLICATIONS

This application is based on and claims priority under 35 USC 119 from Japanese Patent Application No. 2015-052373 filed Mar. 16, 2015.

BACKGROUND

Technical Field

The present invention relates to a support member, an image carrier, and an image forming apparatus.

SUMMARY

According to an aspect of the invention, there is provided a support member that is supported in a cylinder included in an image carrier and that includes six or more contact portions that are arranged in a circumferential direction of the cylinder with spaces therebetween and that are in contact with an inner peripheral surface of the cylinder. The support member is arc-shaped and has a gap at a certain position in the circumferential direction, the gap extending in an axial direction of the cylinder. In a state in which the support member is supported in the cylinder, a groove that extends in the axial direction is formed in the support member such that the groove and the gap are on opposite sides of a center of the cylinder when viewed in the axial direction. In the state in which the support member is supported in the cylinder, the contact portions are symmetrical with respect to a straight line that passes through a center of the gap and a center of the cylinder when viewed in the axial direction. In the state in which the support member is supported in the cylinder, of the contact portions that are on one side of the straight line when viewed in the axial direction, two contact portions that are farthest from each other are separated from each other by approximately 90 degrees or more in the circumferential direction, and two contact portions that are adjacent to each other are separated from each other by approximately 20 degrees or more in the circumferential direction.

BRIEF DESCRIPTION OF THE DRAWINGS

An exemplary embodiment of the present invention will be described in detail based on the following figures, wherein.

DETAILED DESCRIPTION

Figure 1A:
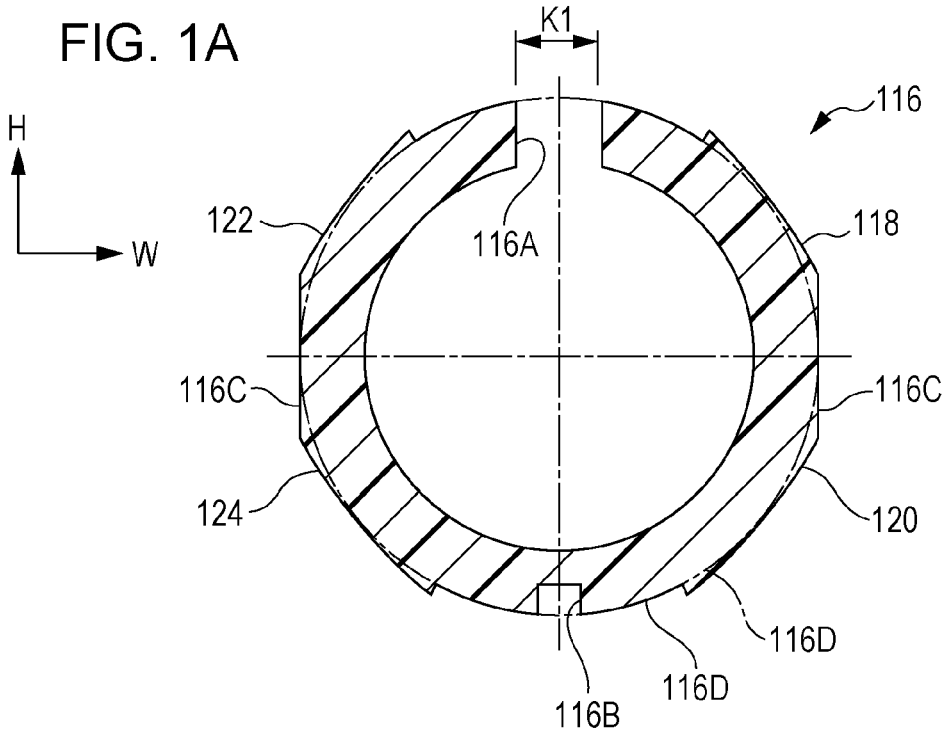
FIGS. 1A and 1B are sectional views of a support member according to a first example of the exemplary embodiment of the present invention.

Examples of a support member, an image carrier, and an image forming apparatus according to an exemplary embodiment of the present invention will be described with reference to FIGS. 1A to 17. In the drawings, the arrow H shows the up-down direction of the apparatus (vertical direction), the arrow W shows the width direction of the apparatus (horizontal direction), and the arrow D shows the depth direction of the apparatus (horizontal direction).

Overall Structure

Figure 14:
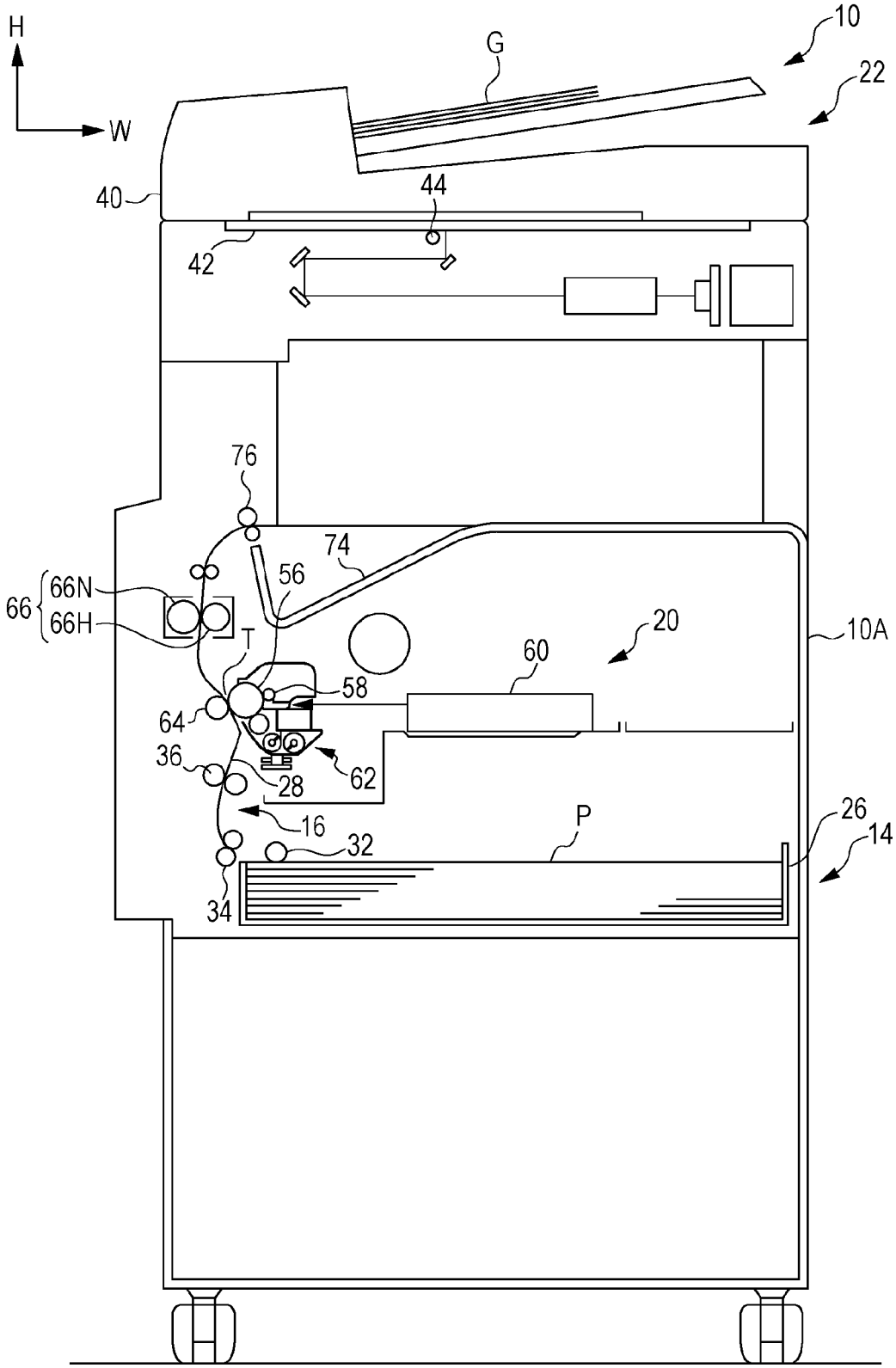
FIG. 14 is a schematic diagram illustrating the image forming apparatus according to the exemplary embodiment of the present invention.

As illustrated in FIG. 14, an image forming apparatus 10 according to the present exemplary embodiment includes a container unit 14, a transport unit 16, an image forming unit 20, and a document reading unit 22, which are arranged in that order from the bottom to top in the up-down direction (direction of arrow H). The container unit 14 contains sheet materials P, which serve as recording media. The transport unit 16 transports the sheet materials P contained in the container unit 14. The image forming unit 20 forms images on the sheet materials P transported from the container unit 14 by the transport unit 16. The document reading unit 22 reads document sheets G.

Container Unit

The container unit 14 includes a container member 26 that may be pulled out from a body 10A of the image forming apparatus 10 toward the front side in the depth direction of the apparatus. The sheet materials P are stacked in the container member 26. The container unit 14 also includes a feed roller 32 that feeds the sheet materials P stacked in the container member 26 to a transport path 28 included in the transport unit 16.

Transport Unit

The transport unit 16 includes separation rollers 34 that are disposed downstream of the feed roller 32 in the direction in which the sheet materials P are transported (hereinafter referred to as downstream in the transporting direction). The separation rollers 34 transport the sheet materials P while separating the sheet materials P from each other.

Positioning rollers 36 are provided on the transport path 28 at a location downstream of the separation rollers 34 in the transporting direction. The positioning rollers 36 temporarily stop each sheet material P and then feed the sheet material P toward a transfer position T, which will be described below, at a predetermined timing.

Output rollers 76 are provided at the downstream end of the transport path 28. The output rollers 76 output the sheet material P on which an image has been formed by the image forming unit 20 to an output unit 74 disposed above the image forming unit 20.

Document Reading Unit

The document reading unit 22 includes a light source 44 that emits light toward a document sheet G that has been transported by an document transport device 40 or placed on a platen glass 42.

Image Forming Unit

Figure 13:
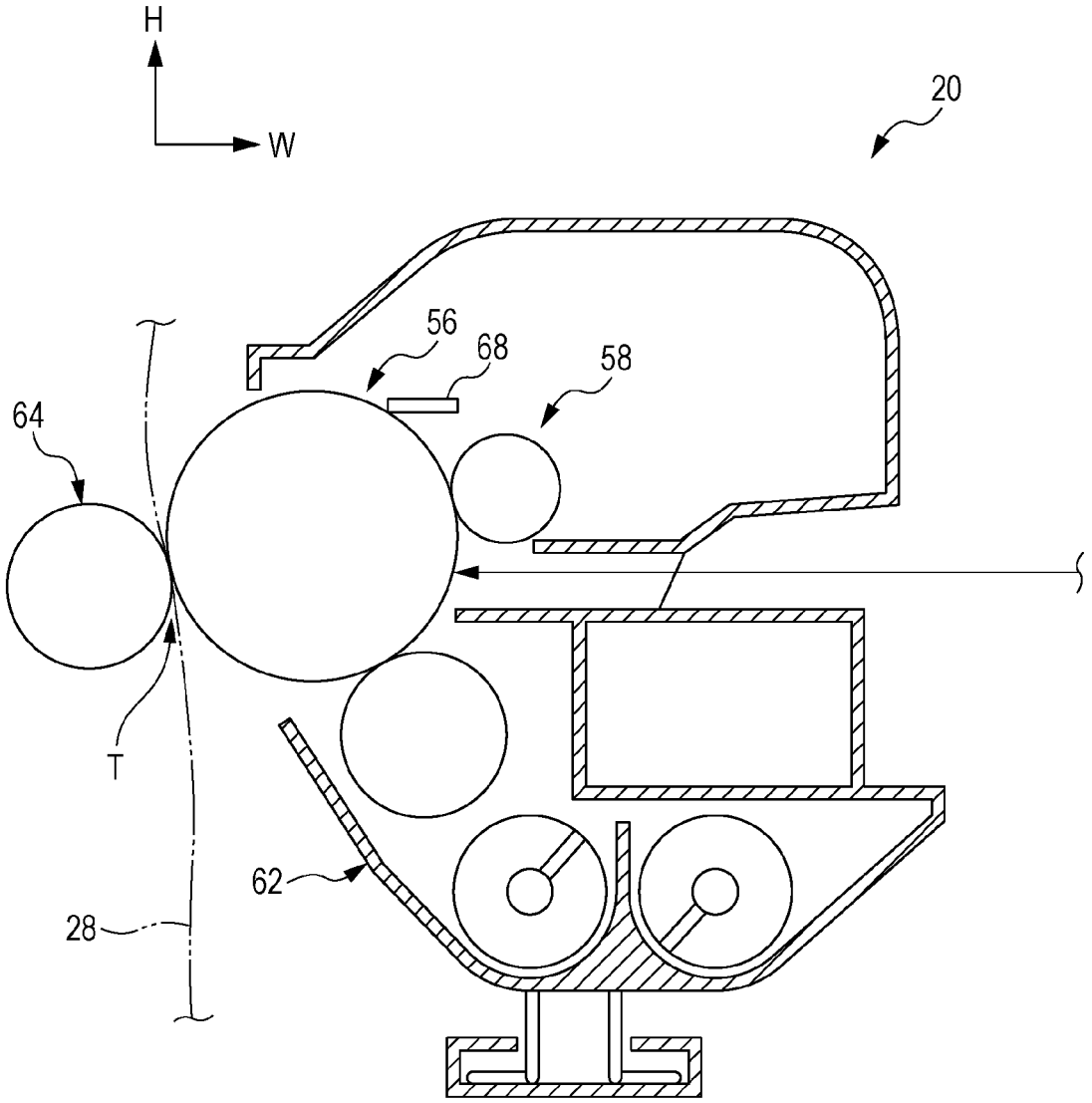
FIG. 13 illustrates an image forming unit included in an image forming apparatus according to the exemplary embodiment of the present invention.

As illustrated in FIG. 13, the image forming unit 20 includes an image carrier 56 and a charging roller 58, which is an example of a charging device that charges a surface of the image carrier 56. The image forming unit 20 also includes an exposure device 60 (see FIG. 14) that irradiates the charged surface of the image carrier 56 with light on the basis of image data to form an electrostatic latent image, and a developing device 62 that visualizes the electrostatic latent image by developing the electrostatic latent image into a toner image.

The image forming unit 20 also includes a transfer roller 64 that transfers the toner image formed on the surface of the image carrier 56 onto the sheet material P that is transported along the transport path 28. The image forming unit 20 also includes a fixing device 66 (see FIG. 14) that includes a heating roller 66H and a pressing roller 66N and fixes the toner image on the sheet material P to the sheet material P by applying heat and pressure. The image forming unit 20 also includes a cleaning blade 68 that cleans the image carrier 56 by scraping off the toner that remains on the image carrier 56 after the toner image has been transferred.

The image carrier 56, the charging roller 58, etc., will be described in detail below.

Operation of Overall Structure

The image forming apparatus 10 forms an image by the following process.

First, a voltage is applied to the charging roller 58 that is in contact with the surface of the image carrier 56, so that the surface of the image carrier 56 is uniformly charged to a predetermined negative potential. Subsequently, the exposure device 60 irradiates the charged surface of the image carrier 56 with exposure light on the basis of image data read by the document reading unit 22 or data input from an external device. Thus, an electrostatic latent image is formed.

Thus, the electrostatic latent image corresponding to the image data is formed on the surface of the image carrier 56. The electrostatic latent image is visualized as a toner image by being developed by the developing device 62.

A sheet material P is fed from the container member 26 to the transport path 28 by the feed roller 32, and is transported toward the transfer position T at a predetermined timing by the positioning rollers 36. The sheet material P is transported while being nipped between the image carrier 56 and the transfer roller 64 at the transfer position T, so that the toner image formed on the surface of the image carrier 56 is transferred onto the sheet material P.

The toner image that has been transferred onto the sheet material P is fixed to the sheet material P when the sheet material P passes through the space between the heating roller 66H and the pressing roller 66N. The sheet material P to which the toner image has been fixed is output to the output unit 74 by the output rollers 76.

Structure of Components

The image carrier 56, the charging roller 58, etc., will now be described.

Charging Roller

Figure 12:
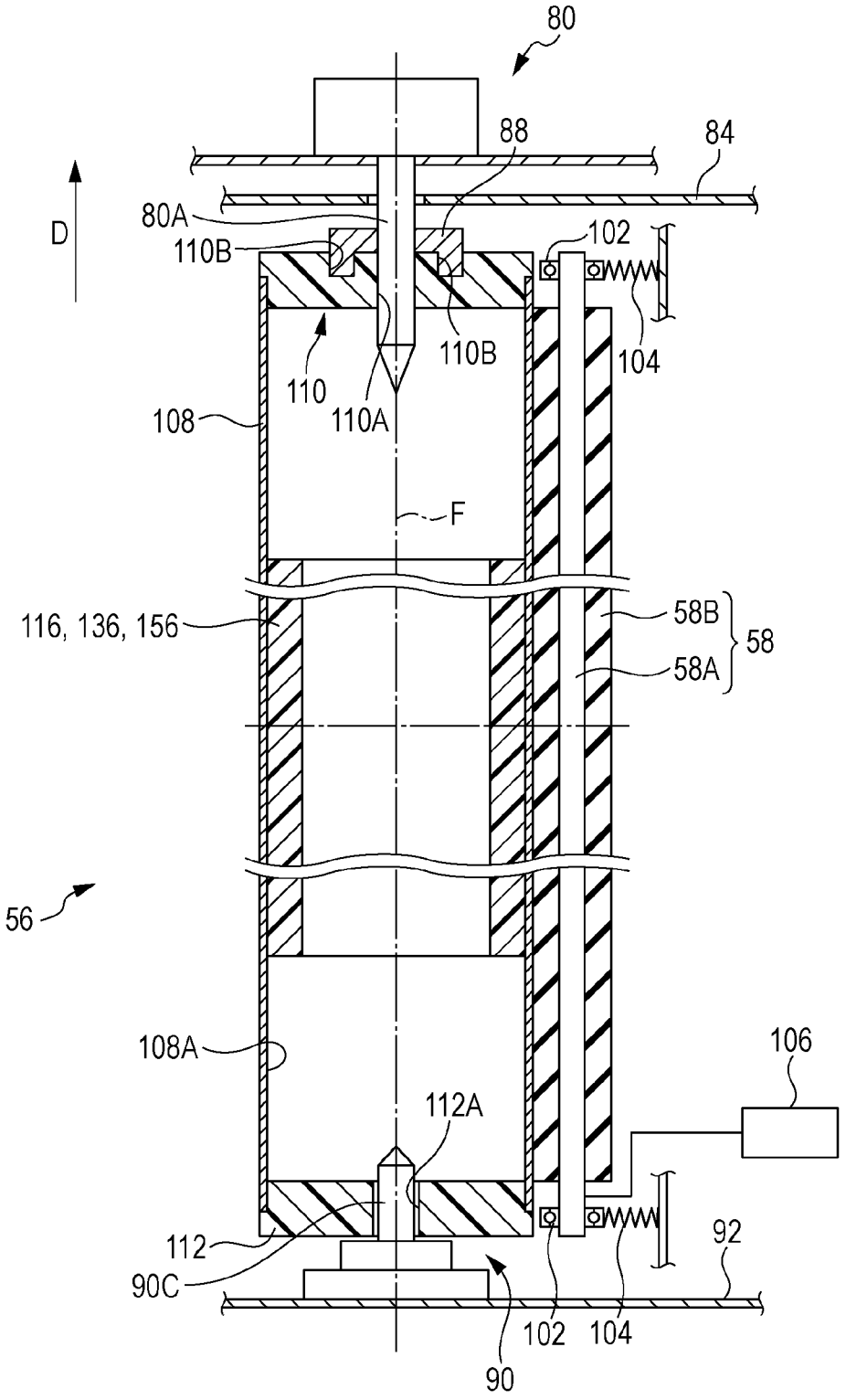
FIG. 12 is a sectional view of an image carrier and other components according to the exemplary embodiment of the present invention.

As illustrated in FIG. 12, the charging roller 58 includes a shaft 58A that extends in the depth direction of the apparatus and that is made of a metal material (for example, a stainless steel), and a roller portion 58B that has a cylindrical shape through which the shaft 58A extends and that is made of a rubber material.

Both ends of the shaft 58A project outward from the roller portion 58B, and are rotatably supported by a pair of bearings 102. Urging members 104 that urge the bearings 102 toward the image carrier 56 are arranged so as to face the image carrier 56 with the shaft 58A disposed therebetween. With this structure, the roller portion 58B of the charging roller 58 is pressed against the image carrier 56. Accordingly, when the image carrier 56 rotates, the charging roller 58 is rotated by the image carrier 56.

A superposed voltage, in which a direct-current voltage and an alternating-current voltage are superposed, is applied to the shaft 58A by a power supply 106.

Image Carrier

As illustrated in FIG. 12, the image carrier 56 includes a cylinder 108 that has a cylindrical shape and extends in the depth direction of the apparatus, and a transmission member 110 that is fixed to the cylinder 108 at a first end (upper end in FIG. 12) of the cylinder 108 in the depth direction of the apparatus (direction similar to the axial direction of the cylinder 108). The image carrier 56 also includes a support member 112 that is fixed to the cylinder 108 at a second end (lower end in FIG. 12) of the cylinder 108 in the depth direction of the apparatus. The image carrier 56 further includes a support member 116 according to a first example, a support member 136 according to a second example, or a support member 156 according to a third example. The support member 116, 136, or 156 is disposed in the cylinder 108 to suppress deformation of the cross sectional shape of the cylinder 108.

The cylinder 108 is formed by forming a photosensitive layer on an outer surface of a cylindrical base made of a metal material. In the present exemplary embodiment, the base of the cylinder 108 is an aluminum tube, and the thickness of the cylinder 108 is 0.8 mm. The outer diameter of the cylinder 108 is 30 mm, and the length of the cylinder 108 in the depth direction of the apparatus is 340 mm.

The transmission member 110 is made of a resin material and is disc-shaped. A portion of the transmission member 110 is fitted to the cylinder 108 so that the transmission member 110 is fixed to the cylinder 108 and seals the opening of the cylinder 108 at the first end of the cylinder 108. A columnar through hole 110A is formed in the transmission member 110 at the center F of the cylinder 108. Plural recesses 110B are formed in an outer surface of the transmission member 110 that faces outward in the depth direction of the apparatus. The recesses 110B are positioned such that the through hole 110A is disposed therebetween.

The support member 112 is made of a resin material and is disc-shaped. A portion of the support member 112 is fitted to the cylinder 108 so that the support member 112 is fixed to the cylinder 108 and seals the opening of the cylinder 108 at the second end of the cylinder 108. A columnar through hole 112A is formed in the support member 112 at the center F of the cylinder 108. The support members 116, 136, and 156 will be described in detail below.

Others

As illustrated in FIG. 12, a motor 80 that generates a rotating force to be transmitted to the image carrier 56 (transmission member 110) is disposed near a first end of the image carrier 56 in the depth direction of the apparatus.

The motor 80 is attached to a plate-shaped frame 84. The motor 80 has a motor shaft 80A that extends through the through hole 110A formed in the transmission member 110. A plate-shaped bracket 88 is fixed to the outer peripheral surface of the motor shaft 80A. The bracket 88 has end portions that are bent and inserted into the recesses 110B in the transmission member 110. Thus, the transmission member 110 transmits the rotating force generated by the motor 80 to the cylinder 108.

A stepped columnar shaft member 90 that supports the image carrier 56 (support member 112) in a rotatable manner is disposed at a second end of the image carrier 56 in the depth direction of the apparatus. The shaft member 90 is attached to a plate-shaped frame 92.

The shaft member 90 includes a shaft portion 90C that extends through the columnar through hole 112A of the support member 112 at the center F of the cylinder 108. A hollow space is provided between the inner peripheral surface of the columnar through hole 112A and the outer peripheral surface of the shaft portion 90C. Thus, the support member 112 functions as a so-called sliding bearing for the shaft portion 90C.

In this structure, when the motor 80 is activated, the motor shaft 80A rotates. The rotation of the motor shaft 80A is transmitted to the cylinder 108 through the bracket 88 and the transmission member 110 fixed to the first end of the cylinder 108. Accordingly, the support member 112 fixed to the second end of the cylinder 108 rotates around the shaft portion 90C. Thus, the image carrier 56 rotates around the center F.

Support Member

The support member 116 according to the first example, the support member 136 according to the second example, and the support member 156 according to the third example that may be supported in the cylinder 108 will now be described.

FIRST EXAMPLE

Referring to FIG. 12, the support member 116 according to the first example may be fitted to the cylinder 108 such that the support member 116 is supported in a central region of the cylinder 108 in the depth direction of the apparatus.

Figure 1B:
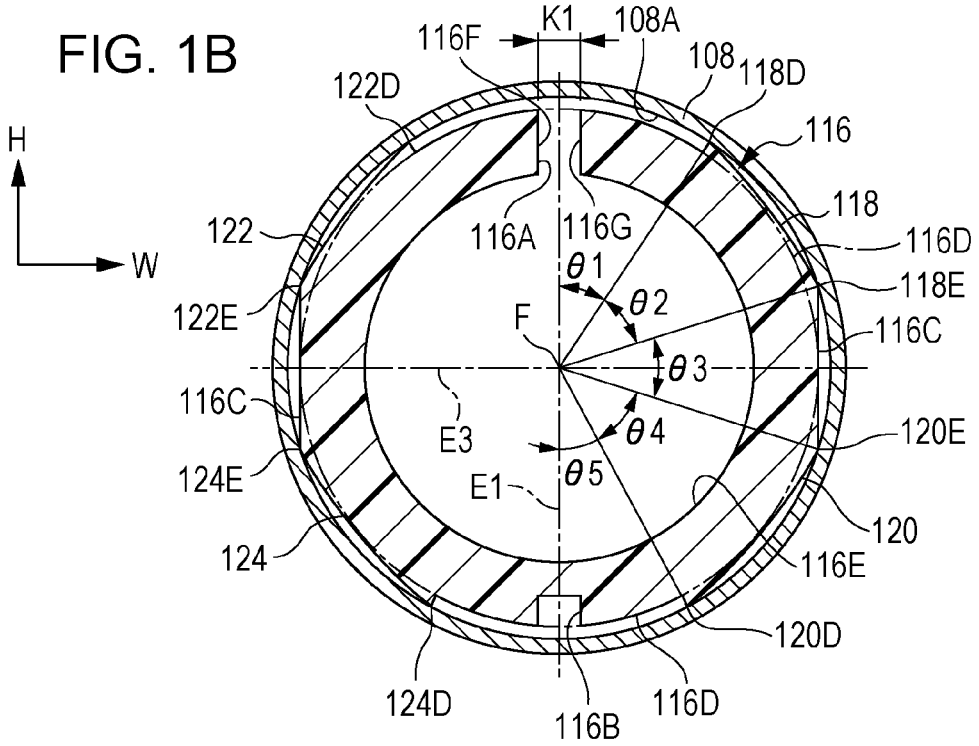

The support member 116 is made of a resin material. As illustrated in FIGS. 1A and 1B, the support member 116 is arc-shaped and includes end portions that face each other with a gap 116A provided therebetween. The gap 116A is formed in the support member 116 so as to extend in the axial direction at a certain position in the circumferential direction. In the first example, the support member 116 is made of an acrylonitrile-butadiene-styrene (ABS) resin. The thickness of the support member 116 is 4 mm, and the length of the support member 116 in the depth direction of the apparatus is 100 mm.

As illustrated in FIG. 1B, in the state in which the support member 116 is supported in the cylinder 108, a groove 116B is formed in the support member 116 such that the groove 116B and the gap 116A are on the opposite sides of the center F of the cylinder 108 when viewed in the depth direction of the apparatus. The groove 116B is formed in an outer peripheral surface 116D of the support member 116 and extends in the depth direction of the apparatus (see FIG. 3).

The outer peripheral surface 116D is shown by the one-dot chain lines and the solid lines in FIG. 1B, and extends in the depth direction of the apparatus. Thus, the outer peripheral surface 116D partially includes an imaginary surface. In the state in which the support member 116 is disposed in the cylinder 108, the outer peripheral surface 116D is a circular surface when viewed in the depth direction of the apparatus. The distance between the outer peripheral surface 116D and an inner peripheral surface 116E of the support member 116 is the above-described thickness of the support member 116.

In the state in which the support member 116 is supported in the cylinder 108, the support member 116 includes a pair of flat portions 116C that are symmetrical to each other with respect to a straight line E1 that passes through the center of the gap 116A and the center F when viewed in the depth direction of the apparatus. As illustrated in FIGS. 1A and 1B, the flat portions 116C are in contact with the outer peripheral surface 116D (imaginary portions), and face in the width direction of the apparatus (left-right direction in FIGS. 1A and 1B). The center of the gap 116A is the middle point between a first end 116F and a second end 116G of the support member 116 that form the gap 116A therebetween.

The support member 116 further includes four projections 118, 120, 122, and 124 that project from the outer peripheral surface 116D toward an inner peripheral surface 108A of the cylinder 108. The projections 118 and 120 are on the right side of the straight line E1 in FIGS. 1A and 1B, and the projections 122 and 124 are on the left side of the straight line E1 in FIGS. 1A and 1B. The projection 118 is provided above the projection 120, and the projection 122 is provided above the projection 124.

In the state in which the support member 116 is supported in the cylinder 108, the projections 118 and 120 are symmetrical to the projections 122 and 124, respectively, with respect to the straight line E1. In addition, in the state in which the support member 116 is supported in the cylinder 108, the projections 118 and 122 are symmetrical to the projections 120 and 124, respectively, with respect to a straight line E3 obtained by rotating the straight line E1 around the center F by 90 degrees when viewed in the depth direction of the apparatus.

The projection 118 will now be described.

Figure 2:
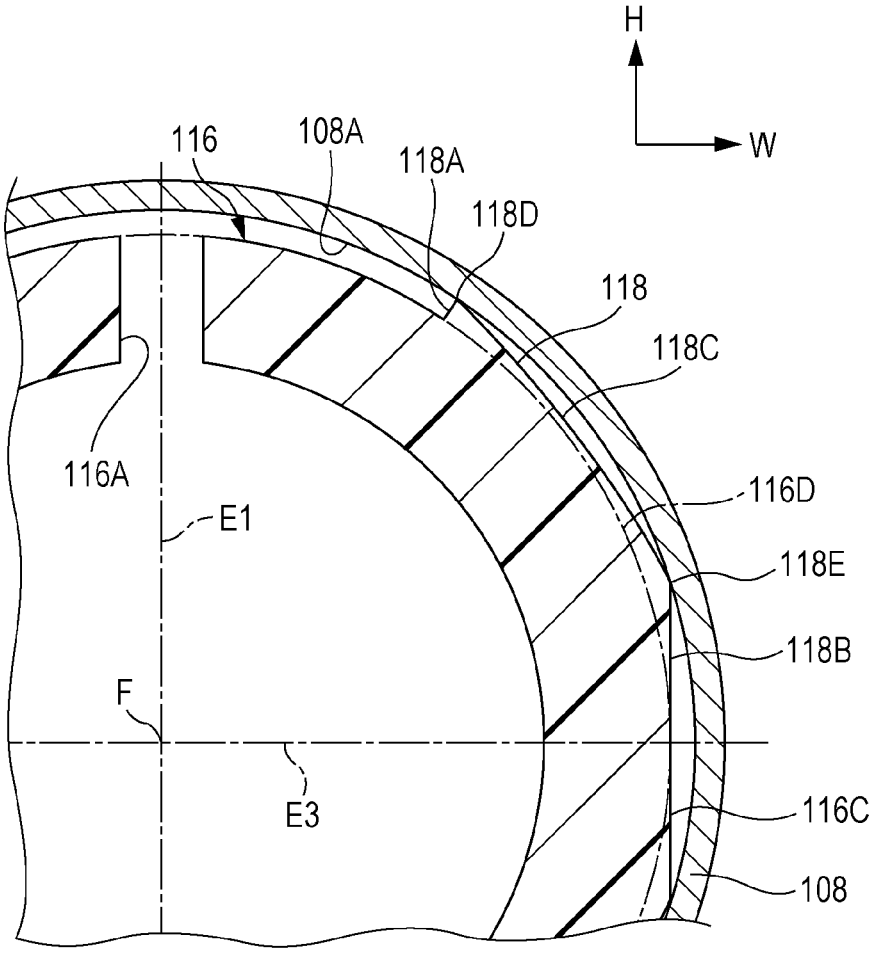
FIG. 2 is an enlarged sectional view of the support member according to the first example of the exemplary embodiment of the present invention.
Figure 3:
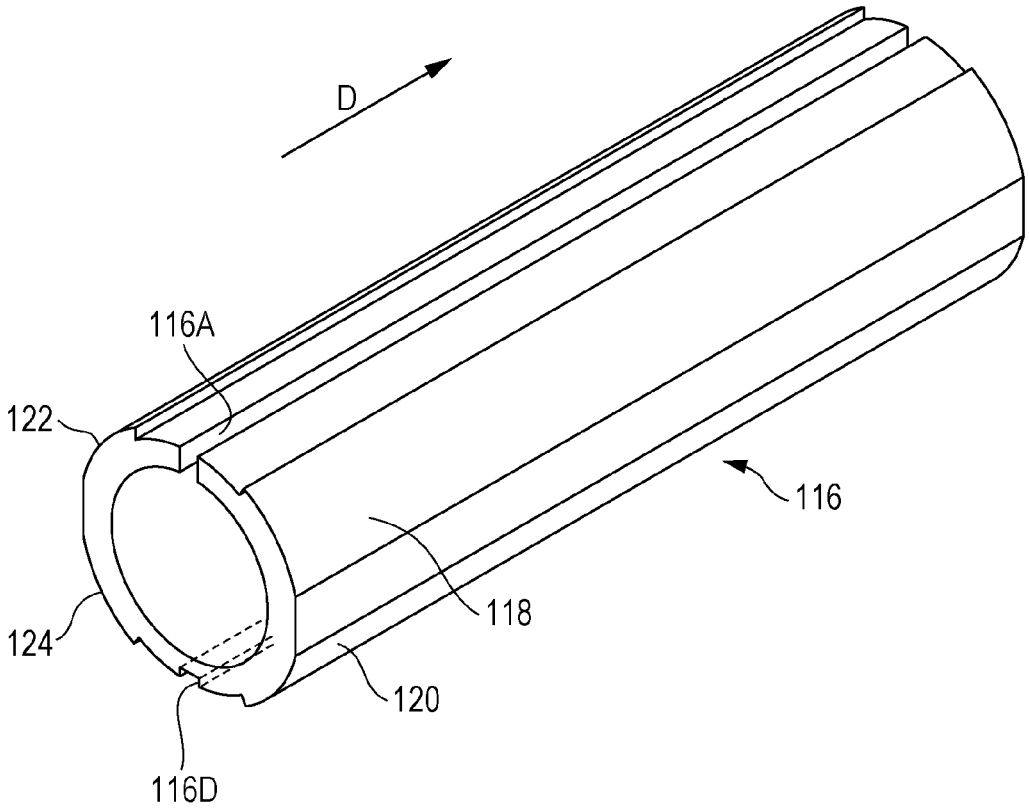
FIG. 3 is a perspective view of the support member according to the first example of the exemplary embodiment of the present invention.

Referring to FIG. 2, when viewed in the depth direction of the apparatus, the projection 118 includes a first side surface 118A and a second side surface 118B that extend from the outer peripheral surface 116D, and a top surface 118C. The projection 118 extends in the depth direction of the apparatus. The first side surface 118A is disposed near the gap 116A, and the second side surface 118B defines a portion of the flat portion 116C.

Only a corner 118D between the top surface 118C and the first side surface 118A and a corner 118E between the top surface 118C and the second side surface 118B are in contact with the inner peripheral surface 108A of the cylinder 108.

As illustrated in FIG. 1B, when viewed in the depth direction of the apparatus, the projections 118 and 120 are symmetrical to each other with respect to the straight line E3, and the projections 118 and 122 are symmetrical to each other with respect to the straight line E1. In addition, the projections 120 and 124 are symmetrical to each other with respect to the straight line E1.

The projection 120 includes corners 120D and 120E, the projection 122 includes corners 122D and 122E, and the projection 124 includes corners 124D and 124E. The corners 118D and 118E, the corners 120D and 120E, the corners 122D and 122E, and the corners 124D and 124E are examples of contact portions that are in contact with the inner peripheral surface 108A of the cylinder 108. Thus, the support member 116 is in contact with the inner peripheral surface 108A of the cylinder 108 at eight points. In other words, the support member 116 includes eight corners that are in contact with the inner peripheral surface 108A of the cylinder 108.

The angle θ1 between the line segment that connects the center of the gap 116A and the center F and the line segment that connects the corner 118D and the center F is 30 degrees. The angle θ2 between the line segment that connects the corner 118D and the center F and the line segment that connects the corner 118E and the center F is 47 degrees. The angle θ3 between the line segment that connects the corner 118E and the center F and the line segment that connects the corner 120E and the center F is 26 degrees. The angle θ4 between the line segment that connects the corner 120E and the center F and the line segment that connects the corner 120D and the center F is 47 degrees. The angle θ5 between the line segment that connects the corner 120D and the center F and the line segment that connects the center of the groove 116B and the center F is 30 degrees.

Namely, among the corners 118D, 118E, 120D, and 120E that are on one side of the straight line E1, the corner 118D at one end and the corner 120D at the other end, which are farthest from each other, are separated from each other by 120 degrees, that is, by an angle greater than or equal to 90 degrees or approximately 90 degrees, in the circumferential direction. Also, the corners 118E and 120E, which are closest to each other, are separated from each other by 26 degrees in the circumferential direction. Thus, every two contact portions that are adjacent to each other are separated from each other by an angle greater than or equal to 20 degrees or approximately 20 degrees.

With this structure, to insert the support member 116 into the cylinder 108, first, the support member 116 is held. When the support member 116 is held, the groove 116B in the support member 116 is deformed such that a separation distance K1 of the gap 116A is reduced (see FIGS. 1A and 1B). Thus, the support member 116 is bent, and is inserted into the cylinder 108 in the bent state.

SECOND EXAMPLE

The support member 136 according to the second example will now be described. The difference between the support member 136 and the support member 116 will be basically described.

Figure 4A:
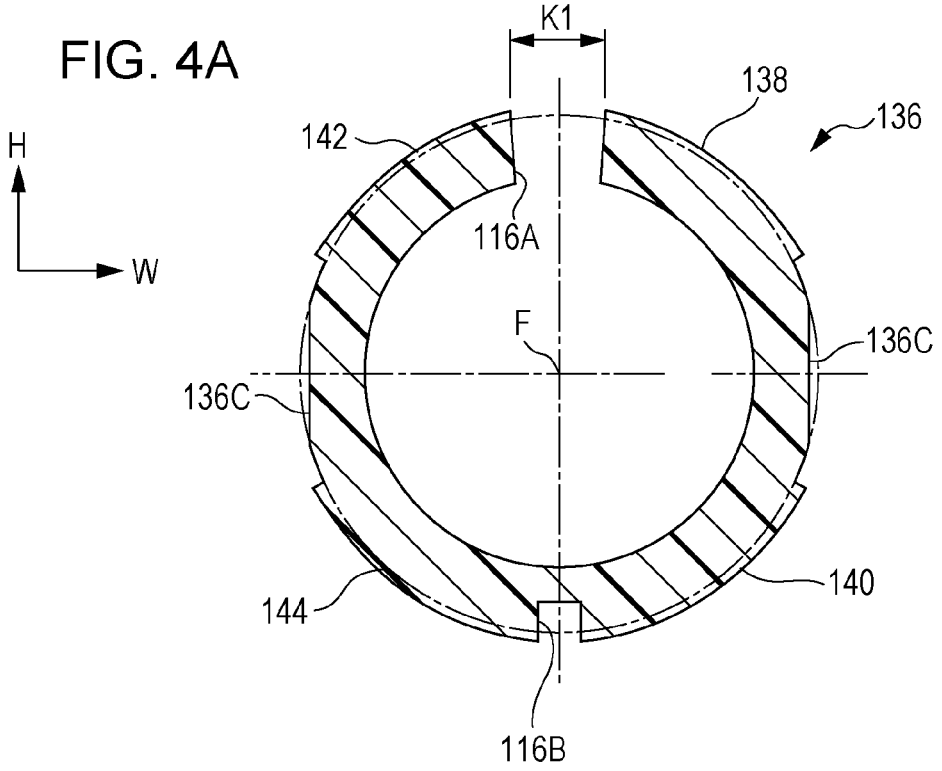
FIGS. 4A and 4B are sectional views of a support member according to a second example of the exemplary embodiment of the present invention.
Figure 4B:
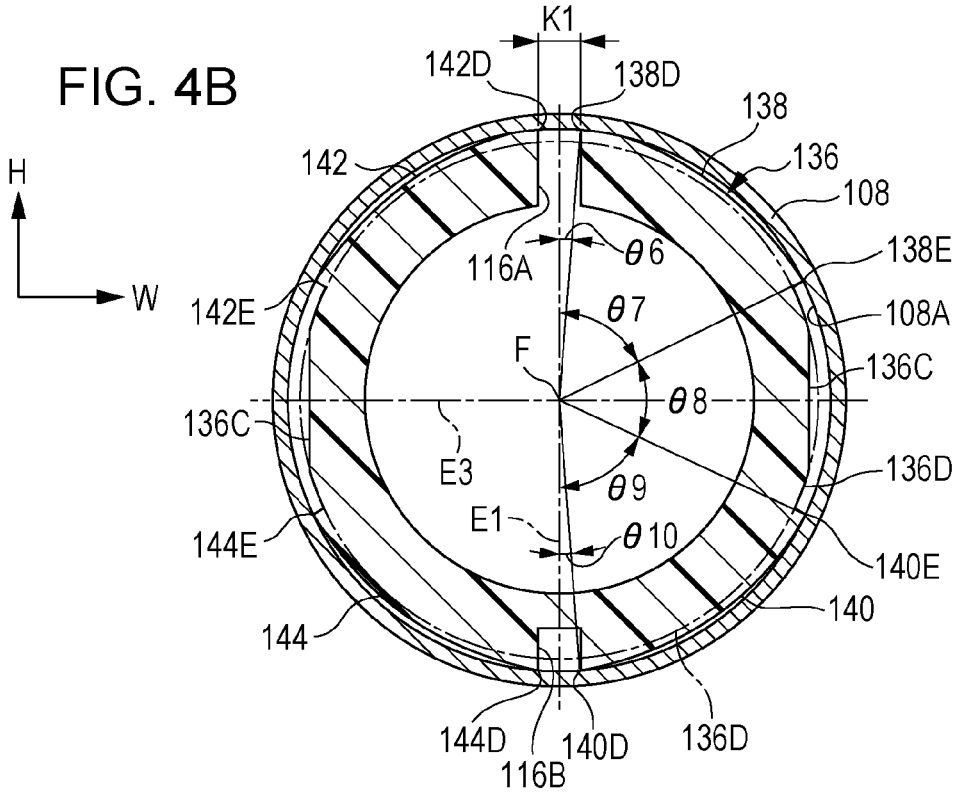

An outer peripheral surface 136D of the support member 136 according to the second example is shown by the one-dot chain lines and the solid lines in FIG. 4B, and extends in the depth direction of the apparatus. In the state in which the support member 136 is disposed in the cylinder 108, the outer peripheral surface 136D is a circular surface when viewed in the depth direction of the apparatus. The outer peripheral surface 136D partially includes an imaginary surface.

In the state in which the support member 136 is supported in the cylinder 108, the support member 136 includes a pair of flat portions 136C that are symmetrical to each other with respect to the straight line E1 when viewed in the depth direction of the apparatus. As illustrated in FIGS. 4A and 4B, the flat portions 136C are recessed from the outer peripheral surface 136D, and face in the width direction of the apparatus (left-right direction in FIGS. 4A and 4B).

The support member 136 further includes four projections 138, 140, 142, and 144 that project from the outer peripheral surface 136D toward the inner peripheral surface 108A of the cylinder 108. The projections 138 and 140 are on the right side of the straight line E1 in FIGS. 4A and 4B, and the projections 142 and 144 are on the left side of the straight line E1 in FIGS. 4A and 4B. The projection 138 is provided above the projection 140, and the projection 142 is provided above the projection 144.

In the state in which the support member 136 is supported in the cylinder 108, the projections 138 and 140 are symmetrical to the projections 142 and 144, respectively, with respect to the straight line E1. In addition, in the state in which the support member 136 is supported in the cylinder 108, the projections 138 and 142 are symmetrical to the projections 140 and 144, respectively, with respect to the straight line E3 when viewed in the depth direction of the apparatus.

The projection 138 will now be described.

Figure 5:
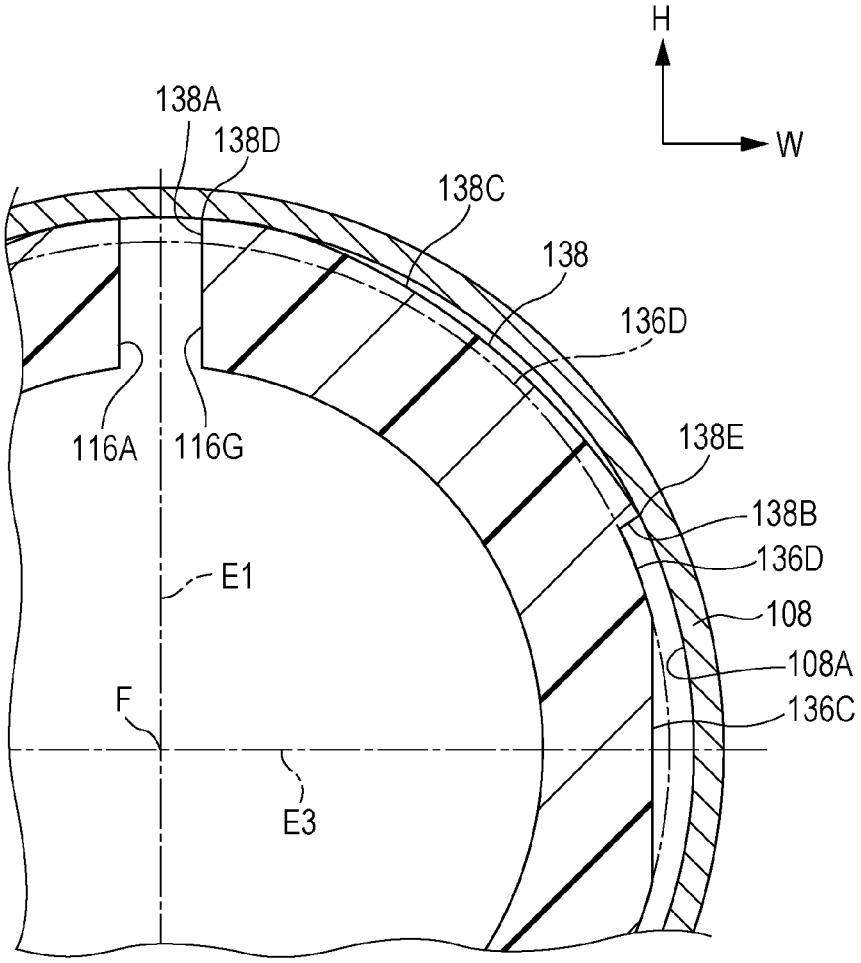
FIG. 5 is an enlarged sectional view of the support member according to the second example of the exemplary embodiment of the present invention.

Referring to FIG. 5, when viewed in the depth direction of the apparatus, the projection 138 includes a first side surface 138A and a second side surface 138B that extend from the outer peripheral surface 136D, and a top surface 138C. The projection 138 extends in the depth direction of the apparatus. The first side surface 138A defines a portion of a second end 116G of the support member 136.

Only a corner 138D between the top surface 138C and the first side surface 138A and a corner 138E between the top surface 138C and the second side surface 138B are in contact with the inner peripheral surface 108A of the cylinder 108.

As illustrated in FIG. 4B, in the state in which the support member 136 is supported in the cylinder 108, when viewed in the depth direction of the apparatus, the projections 138 and 140 are symmetrical to each other with respect to the straight line E3, and the projections 138 and 142 are symmetrical to each other with respect to the straight line E1. In addition, in the state in which the support member 136 is supported in the cylinder 108, the projections 140 and 144 are symmetrical to each other with respect to the straight line E1.

The projection 140 includes corners 140D and 140E, the projection 142 includes corners 142D and 142E, and the projection 144 includes corners 144D and 144E. The corners 138D and 138E, the corners 140D and 140E, the corners 142D and 142E, and the corners 144D and 144E are examples of contact portions that are in contact with the inner peripheral surface 108A of the cylinder 108. Thus, the support member 136 is in contact with the inner peripheral surface 108A of the cylinder 108 at eight points. In other words, the support member 136 includes eight corners that are in contact with the inner peripheral surface 108A of the cylinder 108.

The angle θ6 between the line segment that connects the center of the gap 116A and the center F and the line segment that connects the corner 138D and the center F is 7 degrees. The angle θ7 between the line segment that connects the corner 138D and the center F and the line segment that connects the corner 138E and the center F is 53 degrees. The angle θ8 between the line segment that connects the corner 138E and the center F and the line segment that connects the corner 140E and the center F is 60 degrees. The angle θ9 between the line segment that connects the corner 140E and the center F and the line segment that connects the corner 140D and the center F is 53 degrees. The angle θ10 between the line segment that connects the corner 140D and the center F and the line segment that connects the center of the groove 116B and the center F is 7 degrees.

Namely, among the corners 138D, 138E, 140D, and 140E that are on one side of the straight line E1, the corner 138D at one end and the corner 140D at the other end, which are farthest from each other, are separated from each other by 166 degrees, that is, by an angle greater than or equal to 90 degrees or approximately 90 degrees, in the circumferential direction. Also, the corners 138E and 140E, which are closest to each other, are separated from each other by 60 degrees in the circumferential direction. Thus, every two contact portions that are adjacent to each other are separated from each other by an angle greater than or equal to 20 degrees or approximately 20 degrees.

THIRD EXAMPLE

The support member 156 according to the third example will now be described. The difference between the support member 156 and the support member 116 will be basically described.

Figure 6A:
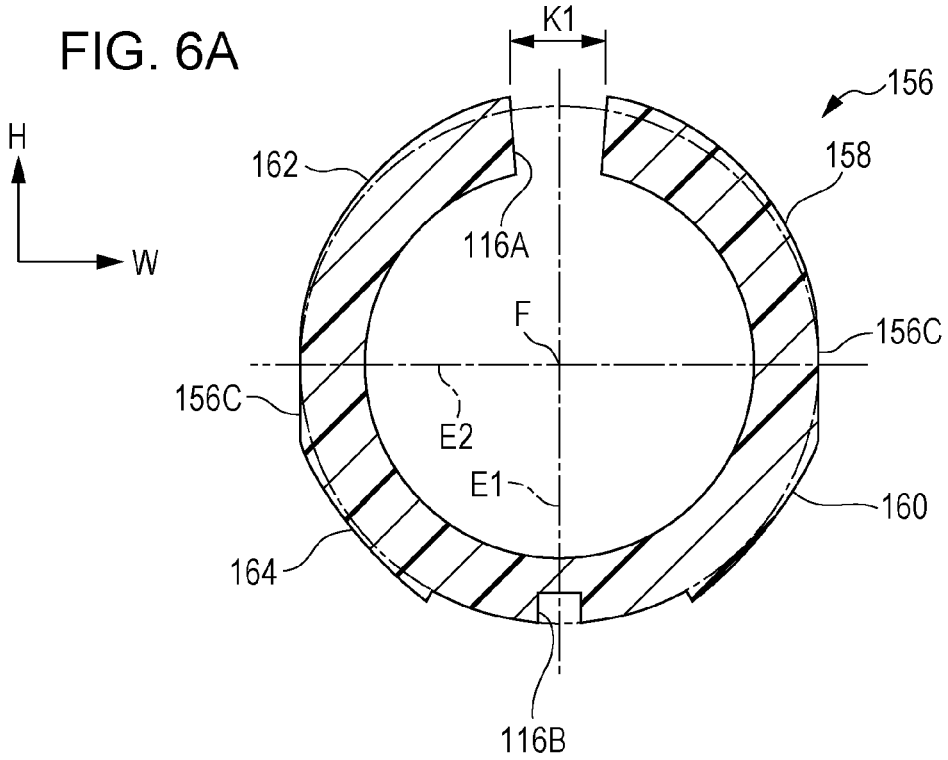
FIGS. 6A and 6B are sectional views of a support member according to a third example of the exemplary embodiment of the present invention.
Figure 6B:
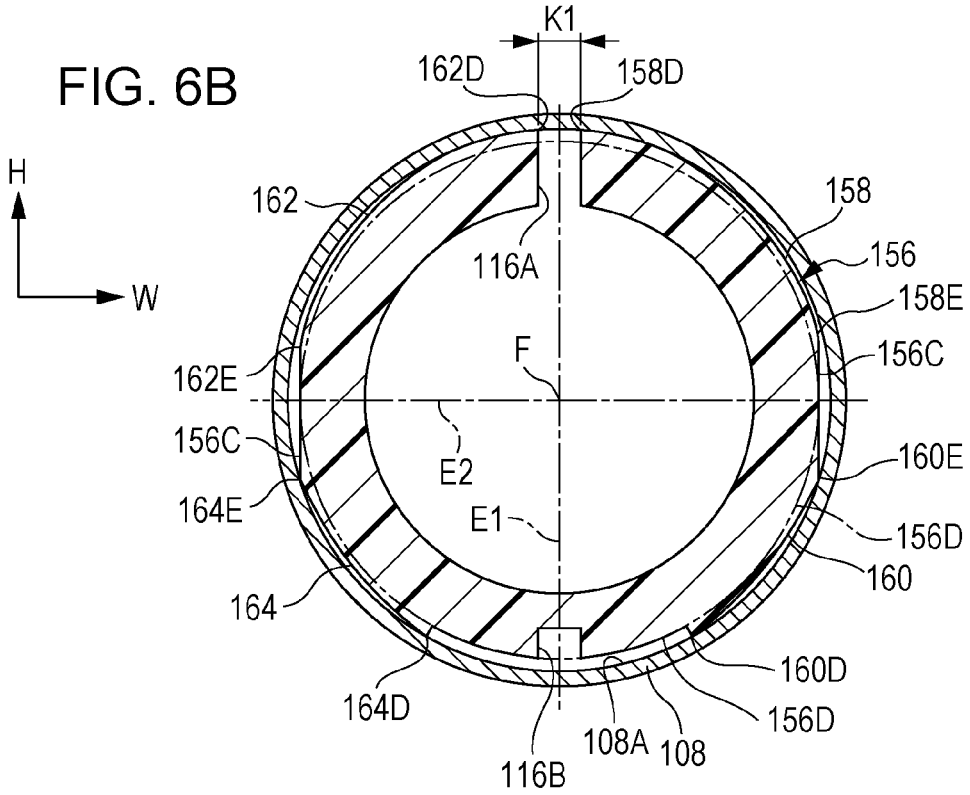

An outer peripheral surface 156D of the support member 156 according to the third example is shown by the one-dot chain lines and the solid lines in FIG. 6B, and extends in the depth direction of the apparatus. In the state in which the support member 156 is disposed in the cylinder 108, the outer peripheral surface 156D is a circular surface when viewed in the depth direction of the apparatus. The outer peripheral surface 156D partially includes an imaginary surface.

In the state in which the support member 156 is supported in the cylinder 108, the support member 156 includes a pair of flat portions 156C that are symmetrical to each other with respect to the straight line E1 when viewed in the depth direction of the apparatus. As illustrated in FIGS. 6A and 6B, the flat portions 156C are in contact with the outer peripheral surface 156D (imaginary portions), and face in the width direction of the apparatus (left-right direction in FIGS. 6A and 6B).

The support member 156 further includes four projections 158, 160, 162, and 164 that project from the outer peripheral surface 156D toward the inner peripheral surface 108A of the cylinder 108. The projections 158 and 160 are on the right side of the straight line E1 in FIGS. 6A and 6B, and the projections 162 and 164 are on the left side of the straight line E1 in FIGS. 6A and 6B. The projection 158 is provided above the projection 160, and the projection 162 is provided above the projection 164.

In the state in which the support member 156 is supported in the cylinder 108, the projections 158 and 160 are symmetrical to the projections 162 and 164, respectively, with respect to the straight line E1.

The projections 158 and 160 will now be described.

Figure 7:
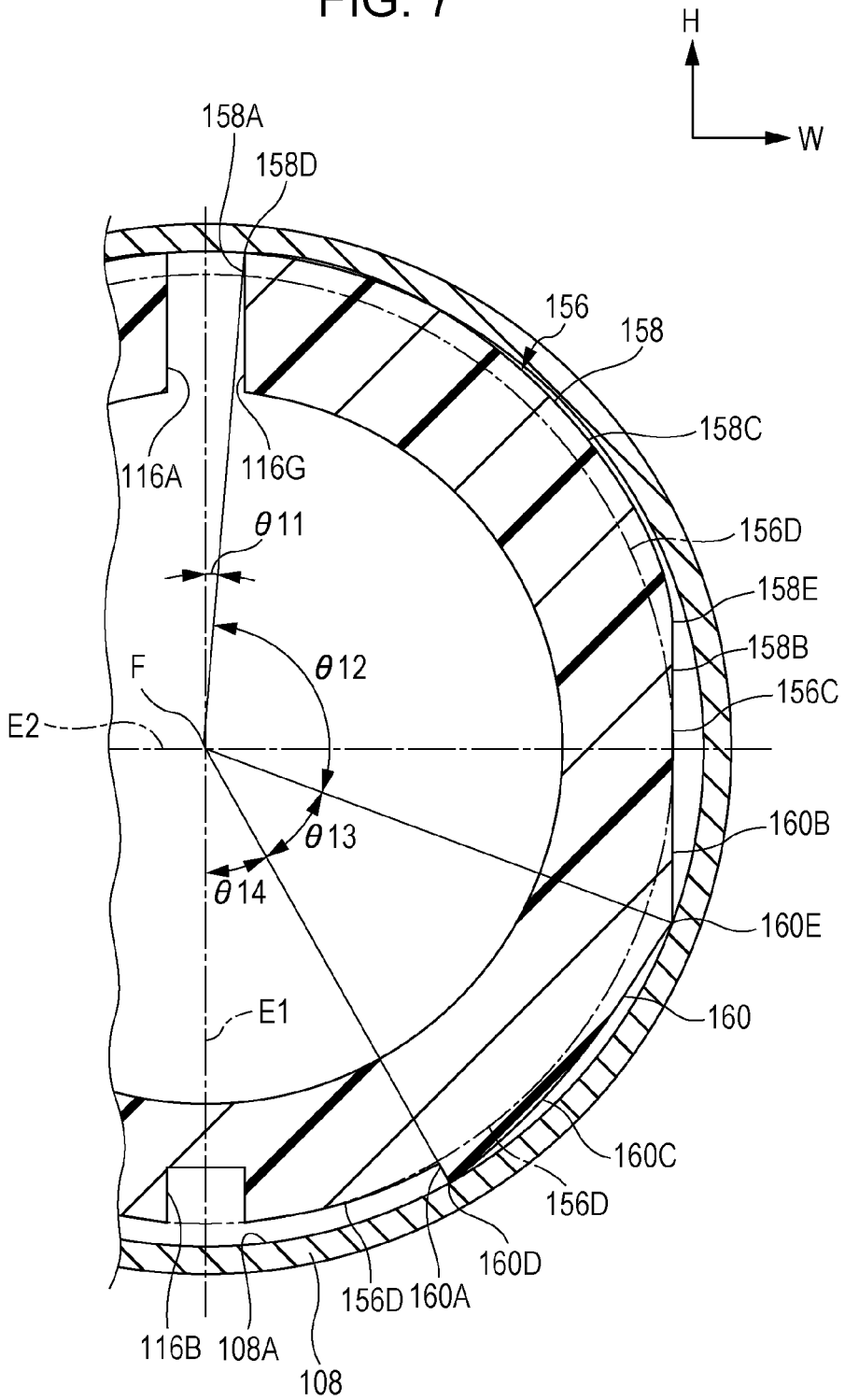
FIG. 7 is an enlarged sectional view of the support member according to the third example of the exemplary embodiment of the present invention.

Referring to FIG. 7, when viewed in the depth direction of the apparatus, the projection 158 includes a first side surface 158A and a second side surface 158B that extend from the outer peripheral surface 156D, and a top surface 158C. The projection 158 extends in the depth direction of the apparatus. The first side surface 158A defines a portion of a second end 116G of the support member 156, and the second side surface 158B defines a portion of the flat portion 156C.

A corner 158D is formed between the top surface 158C and the first side surface 158A, and a corner 158E is formed between the top surface 158C and the second side surface 158B. Only the corner 158D is in contact with the inner peripheral surface 108A of the cylinder 108.

When viewed in the depth direction of the apparatus, the projection 160 includes a first side surface 160A and a second side surface 160B that extend from the outer peripheral surface 156D, and a top surface 160C. The projection 160 extends in the depth direction of the apparatus. The second side surface 160B defines a portion of the flat portion 156C.

Only a corner 160D between the top surface 160C and the first side surface 160A and a corner 160E between the top surface 160C and the second side surface 160B are in contact with the inner peripheral surface 108A of the cylinder 108.

As illustrated in FIG. 6B, the projection 162 includes corners 162D and 162E, and the projection 164 includes corners 164D and 164E.

The corner 158D, the corners 160D and 160E, the corner 162D, and the corners 164D and 164E are examples of contact portions that are in contact with the inner peripheral surface 108A of the cylinder 108. The support member 156 is in contact with the inner peripheral surface 108A of the cylinder 108 at six points. In other words, the support member 156 includes six corners that are in contact with the inner peripheral surface 108A of the cylinder 108.

As illustrated in FIG. 7, the angle θ11 between the line segment that connects the center of the gap 116A and the center F and the line segment that connects the corner 158D and the center F is 5 degrees. The angle θ12 between the line segment that connects the corner 158D and the center F and the line segment that connects the corner 160E and the center F is 100 degrees. The angle θ13 between the line segment that connects the corner 160E and the center F and the line segment that connects the corner 160D and the center F is 45 degrees. The angle θ14 between the line segment that connects the corner 160D and the center F and the line segment that connects the center of the groove 116B and the center F is 30 degrees.

Namely, among the corners 158D, 160D, and 160E that are on one side of the straight line E1, the corner 158D at one end and the corner 160D at the other end, which are farthest from each other, are separated from each other by 145 degrees, that is, by an angle greater than or equal to 90 degrees or approximately 90 degrees, in the circumferential direction. Also, the corners 160E and 160D, which are closest to each other, are separated from each other by 45 degrees in the circumferential direction. Thus, every two contact portions that are adjacent to each other are separated from each other by an angle greater than or equal to 20 degrees or approximately 20 degrees.

Operation of Structure

The operation of the image carrier 56, the charging roller 58, etc., will be described.

When the motor 80 is activated, the image carrier 56 rotates (see FIG. 12). When the image carrier 56 rotates, the charging roller 58 is rotated by the image carrier 56. To charge the photosensitive layer (not shown) of the image carrier 56, the power supply 106 applies a superposed voltage, in which a direct-current voltage and an alternating-current voltage are superposed, to the shaft 58A of the charging roller 58.

Owing to the alternating-current voltage (1 to 3 kHz) included in the superposed voltage, an alternating electric field is generated between the charging roller 58 and the image carrier 56. Accordingly, a periodic electrostatic attraction force (2 to 6 kHz) is generated between the image carrier 56 and the charging roller 58.

A support member 200 and a support member 250 will be described as a first comparative example and a second comparative example, respectively, to be compared with the support members 116, 136, and 156 according to the above-described examples. The differences between each of the support members 200 and 250 and the support member 116 will be basically described.

First, the support member 200 will be described as a first comparative example.

Figure 15A:
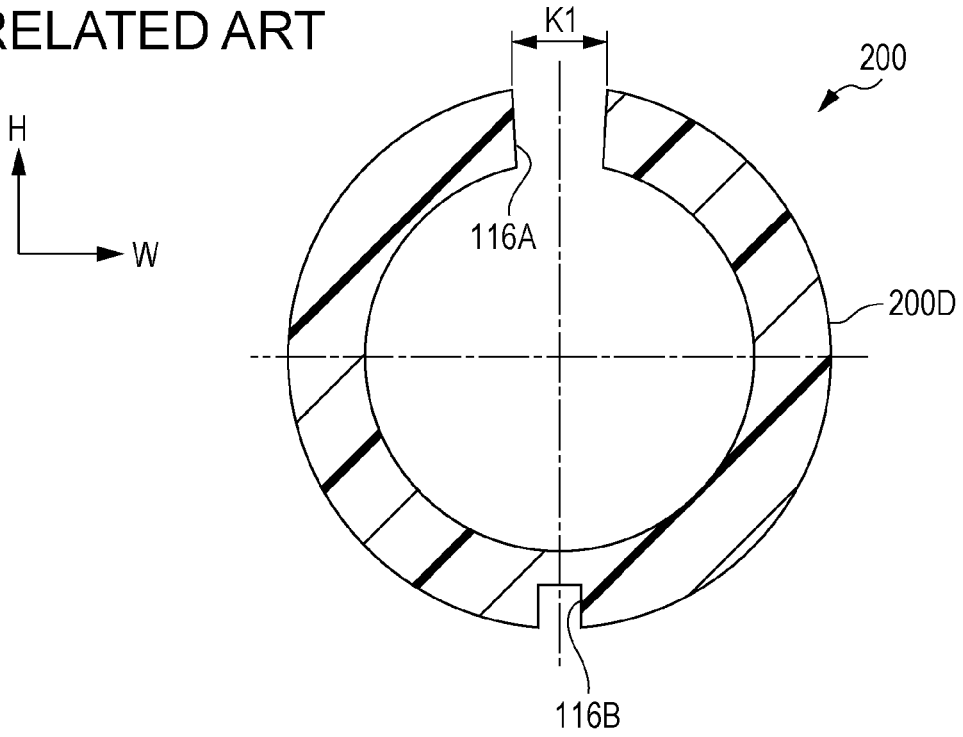
FIG. 15A RELATED ART
FIGS. 15A and 15B are sectional views of a support member according to a first comparative example to be compared with the support members of the exemplary embodiment of the present invention.
Figure 15B:
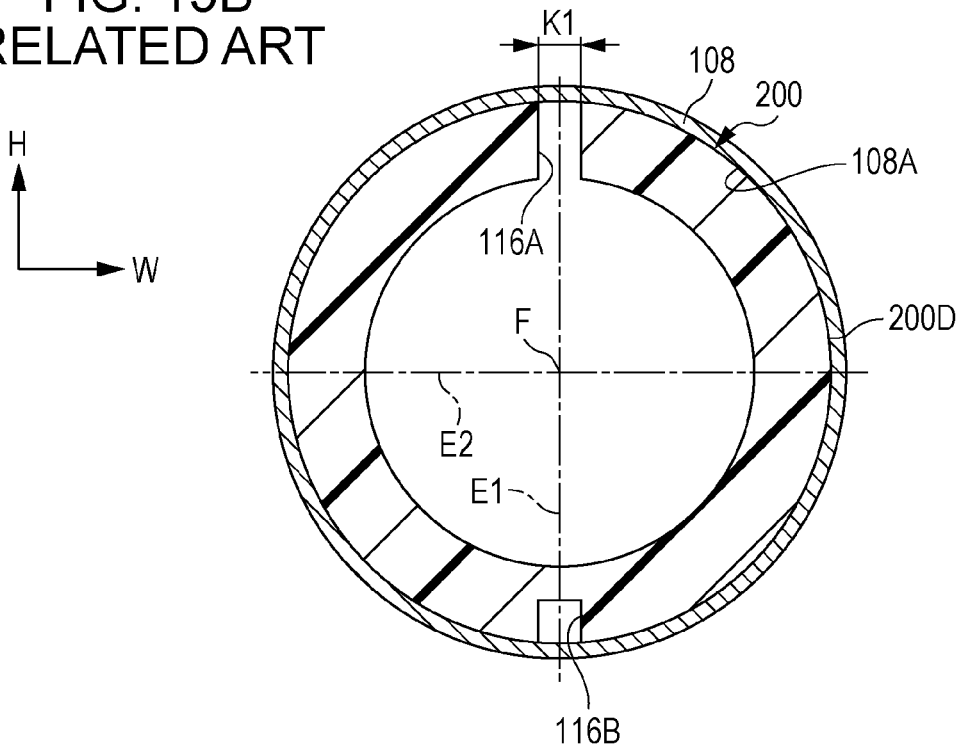
FIG. 15B RELATED ART

As illustrated in FIGS. 15A and 15B, the support member 200 has an outer peripheral surface 200D that does not have projections or flat portions. The support member 200 is C-shaped in cross section. The support member 200 is designed so that the outer peripheral surface 200D thereof comes into contact with the inner peripheral surface 108A of the cylinder 108 over the entire region thereof.

Owing to the individual differences between support members and cylinders, the outer peripheral surface 200D of the support member 200 rarely comes into contact with the inner peripheral surface 108A of the cylinder 108 over the entire region thereof. Therefore, portions of the outer peripheral surface 200D of the support member 200 come into contact with the inner peripheral surface 108A of the cylinder 108. In addition, the positions at which the portions of the outer peripheral surface 200D of the support member 200 come into contact with the inner peripheral surface 108A of the cylinder 108 vary. Therefore, there is a possibility that vibration of the cylinder 108 cannot be reduced.

Next, the support member 250 will be described as a second comparative example.

Figure 16A:
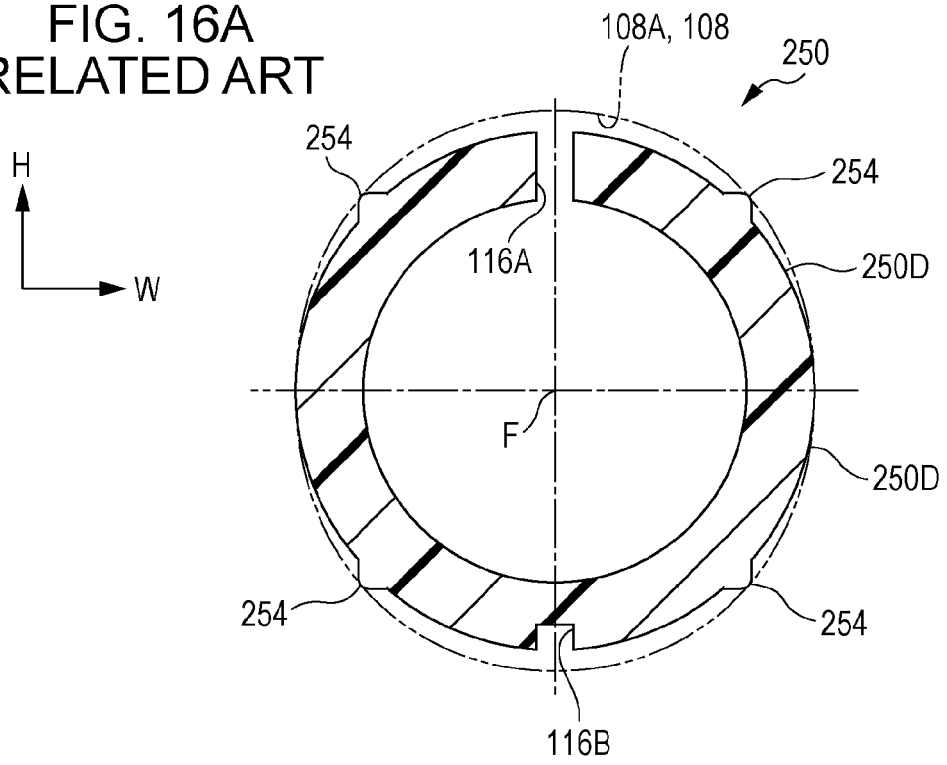
FIG. 16A RELATED ART
FIGS. 16A and 16B are sectional views of a support member according to a second comparative example to be compared with the support members of the exemplary embodiment of the present invention.
Figure 16B:
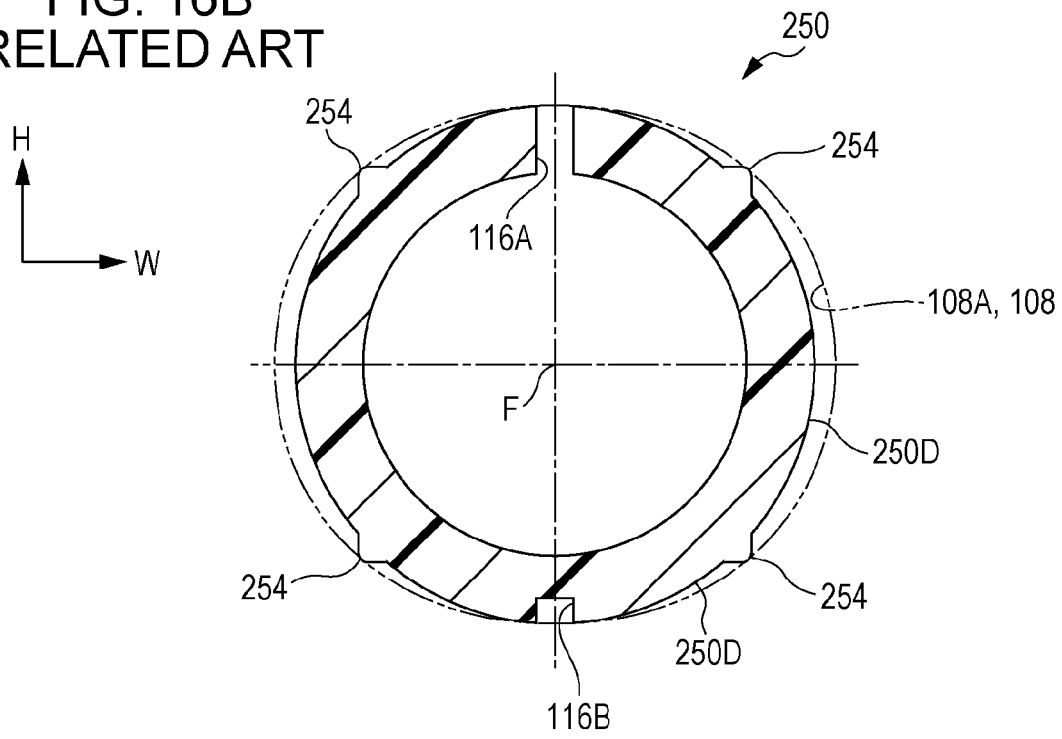
FIG. 16B RELATED ART

As illustrated in FIGS. 16A and 16B, the support member 250 has an outer peripheral surface 250D on which four projections 254 are arranged with constant intervals therebetween in the circumferential direction. The tips of the projections 254 are in contact with the inner peripheral surface 108A of the cylinder 108. Thus, the support member 250 is in contact with the inner peripheral surface 108A of the cylinder 108 at four positions. In other words, the support member 250 includes four contact portions that are in contact with the inner peripheral surface 108A of the cylinder 108.

The projections 254 are arranged at an angle of 45 degrees with respect to the directions in which the cylinder 108 is compressed when the cylinder 108 vibrates (left-right direction and up-down direction in FIGS. 16A and 16B).

Unlike the first comparative example, the outer peripheral surface 250D is not designed so as to come into contact with the inner peripheral surface 108A of the cylinder 108 over the entire region thereof. Therefore, the positions at which the support member 250 comes into contact with the inner peripheral surface 108A of the cylinder 108 do not vary.

However, as shown by the two-dot chain lines in FIGS. 16A and 16B, when the cross sectional shape of the cylinder 108 periodically changes to an oval shape that extends in the vertical or horizontal direction, deformation of the cross sectional shape of the cylinder 108 cannot be suppressed.

In contrast, the support member 116 according to the first example is in contact with the inner peripheral surface 108A of the cylinder 108 at eight positions. In addition, in the state in which the support member 116 is supported in the cylinder 108, when viewed in the depth direction of the apparatus, the corners 118D, 118E, 120D, and 120E, are symmetrical to the corners 122D, 122E, 124D, and 124E, respectively, with respect to the straight line E1 (see FIG. 1B).

Similarly, the support member 136 according to the second example is in contact with the inner peripheral surface 108A of the cylinder 108 at eight positions. In addition, in the state in which the support member 136 is supported in the cylinder 108, when viewed in the depth direction of the apparatus, the corners 138D, 138E, 140D, and 140E, are symmetrical to the corners 142D, 142E, 144D, and 144E, respectively, with respect to the straight line E1 (see FIG. 4B).

In addition, the support member 156 according to the third example is in contact with the inner peripheral surface 108A of the cylinder 108 at six positions. In addition, in the state in which the support member 156 is supported in the cylinder 108, when viewed in the depth direction of the apparatus, the corners 158D, 160D, and 160E are symmetrical to the corners 162D, 164D, and 164E, respectively, with respect to the straight line E1 (see FIG. 6B).

Accordingly, unlike the first comparative example, the positions at which the support members 116, 136, and 156 are in contact with the inner peripheral surface 108A of the cylinder 108 do not vary.

In addition, in the case where the support member 116, 136, or 156 is used, the number of positions at which the support member 116, 136, or 156 is in contact with the inner peripheral surface 108A of the cylinder 108 is six or more. Moreover, among the contact portions that are on one side of the straight line E1, two contact portions that are farthest from each other are separated from each other by an angle greater than or equal to 90 degrees or approximately 90 degrees in the circumferential direction, and two contact portions that are adjacent to each other are separated from each other by an angle greater than or equal to 20 degrees or approximately 20 degrees. Thus, compared to the second comparative example, deformation of the cross sectional shape of the cylinder 108 is reduced.

Evaluation

Deformations of the cylinder 108 caused when the support members 116, 136, and 156 according to the first to third examples and the support member 200 according to the first comparative example are supported in the cylinder 108 are evaluated through simulations by the finite element method.

Figure 8:
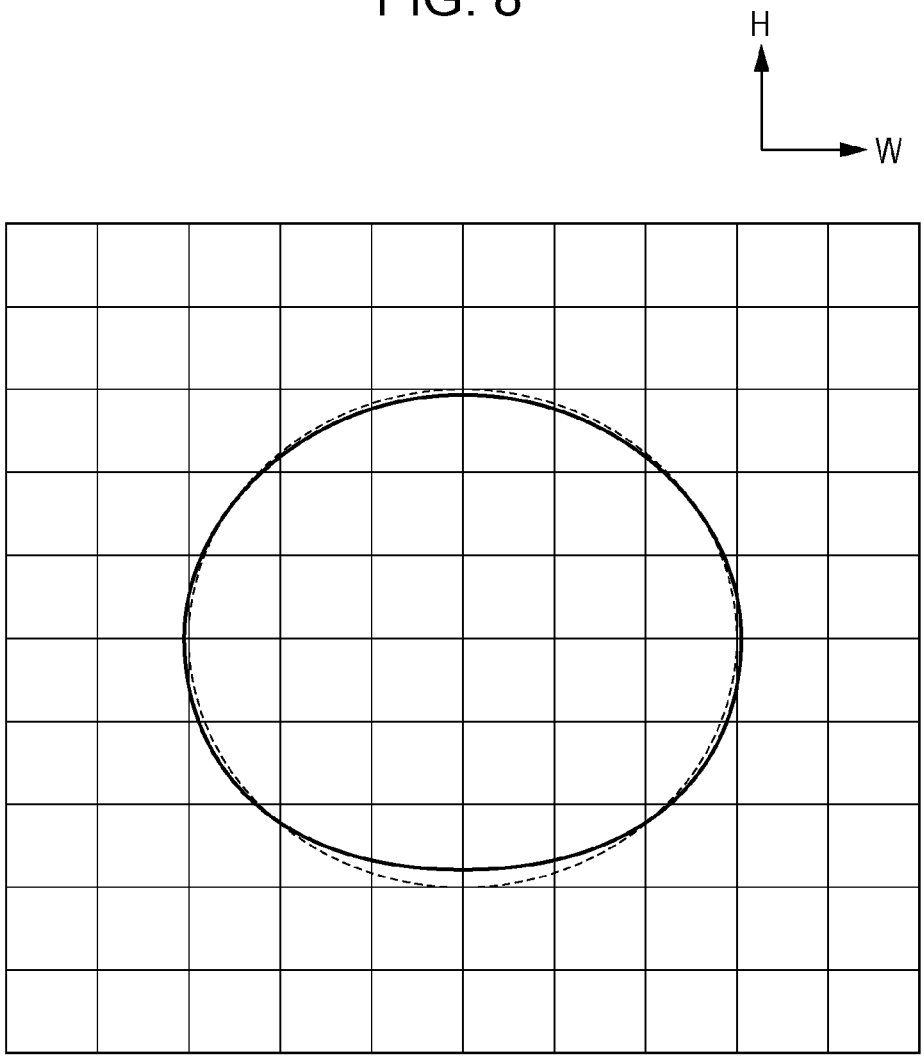
FIG. 8 illustrates a deformation mode of a cylinder in the case where the support member according to the first example of the exemplary embodiment of the present invention is supported by the cylinder.
Figure 9:
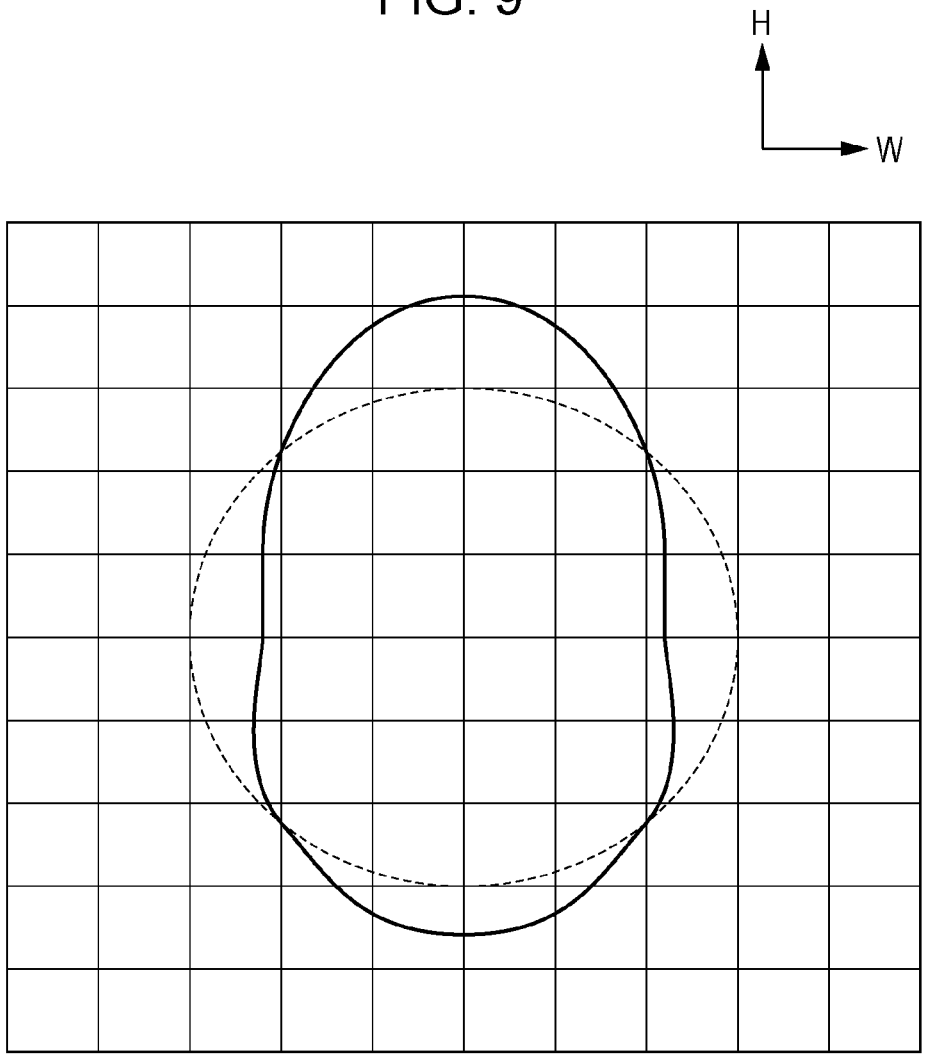
FIG. 9 illustrates a deformation mode of the cylinder in the case where the support member according to the second example of the exemplary embodiment of the present invention is supported by the cylinder.
Figure 10:
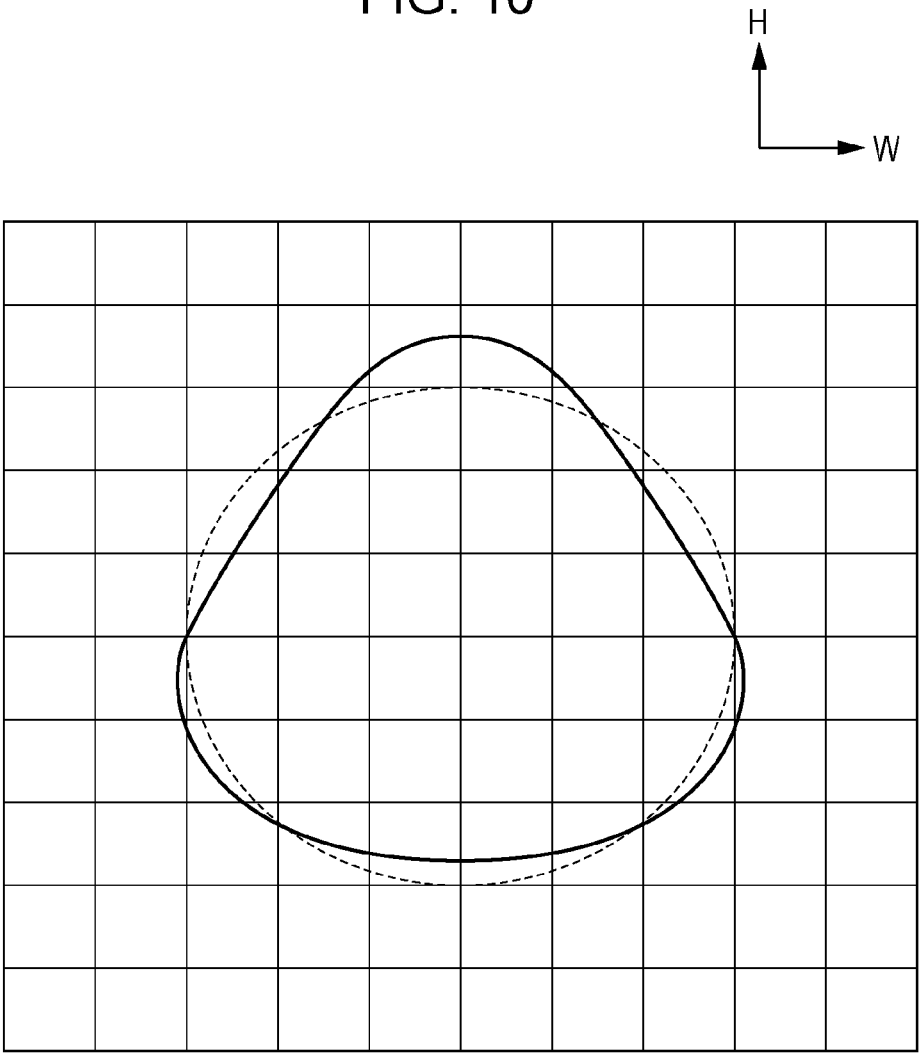
FIG. 10 illustrates a deformation mode of the cylinder in the case where the support member according to the third example of the exemplary embodiment of the present invention is supported by the cylinder.
Figure 17:
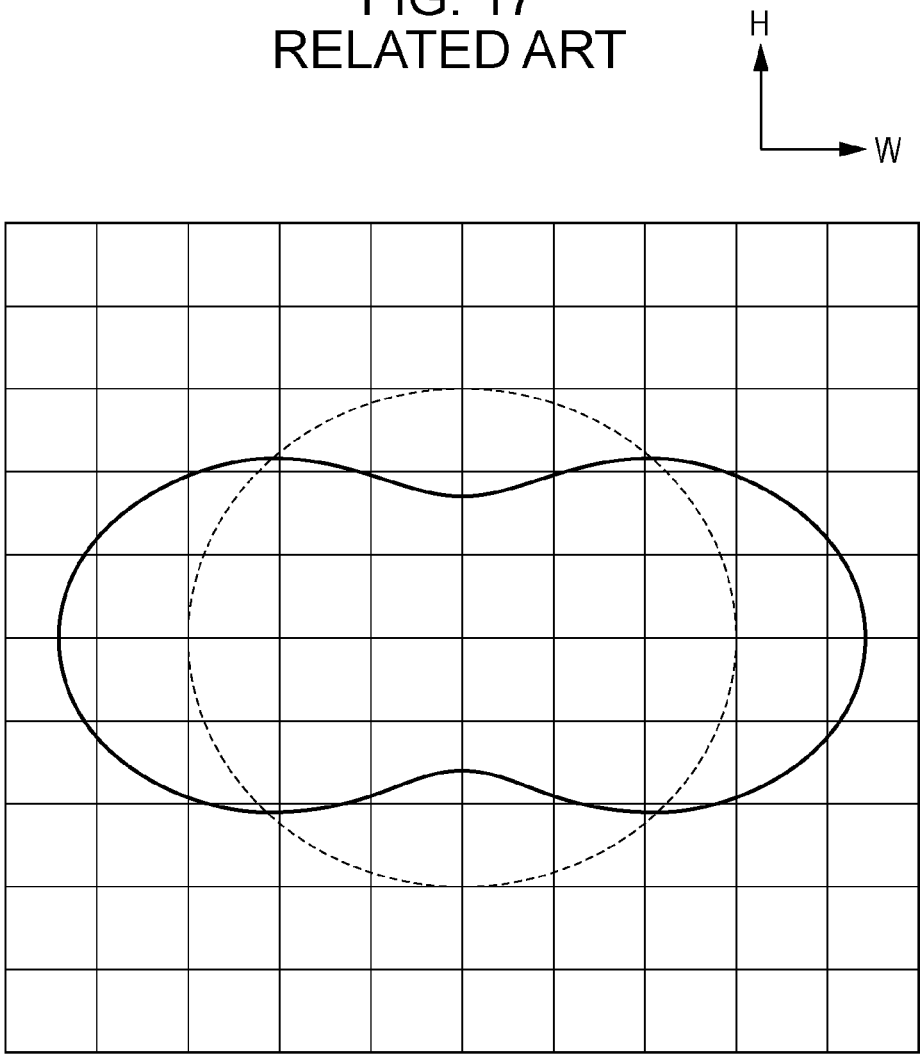
FIG. 17 RELATED ART
FIG. 17 illustrates a deformation mode of the cylinder in the case where the support member according to the first comparative example to be compared with the support members of the exemplary embodiment of the present invention is supported by the cylinder.

FIG. 17 shows the result of the simulation for when the support member 200 according to the first comparative example is used. FIG. 8 shows the result of the simulation for when the support member 116 according to the first example is used. FIG. 9 shows the result of the simulation for when the support member 136 according to the second example is used. FIG. 10 shows the result of the simulation for when the support member 156 according to the third example is used.

In FIGS. 17 and 8 to 10, the dashed lines show the shape of the cylinder 108 in the state in which the support members 200, 116, 136, and 156 are not supported therein, and the solid lines show the shapes of the cylinder 108 in the state in which the support members 200, 116, 136, and 156 are supported therein. The deformation of the cylinder 108 is exaggerated to facilitate understanding.

As illustrated in FIG. 17, in the case where the support member 200 according to the first comparative example is supported in the cylinder 108, the cylinder 108 is greatly deformed so as to expand in the width direction of the apparatus (left-right direction in FIG. 17). The cylinder 108 is greatly deformed so as to expand in the left-right direction in FIG. 17 probably because the outer peripheral surface 200D of the support member 200 is in contact with the inner peripheral surface 108A of the cylinder 108 over the entire region thereof.

As illustrated in FIGS. 8, 9, and 10, in the case where the support members 116, 136, and 156 according to the first to third examples are supported in the cylinder 108, the amounts of deformation of the cylinder 108 in the width direction of the apparatus and the up-down direction of the apparatus (up-down direction in FIGS. 8, 9, and 10) are smaller than the amount of deformation of the cylinder 108 in the case where the outer peripheral surface of the support member 200 is contact with the inner peripheral surface 108A of the cylinder 108 over the entire region thereof. This is probably because the outer peripheral surfaces 116D, 136D, and 156D of the support members 116, 136, and 156, respectively, are in contact with the inner peripheral surface 108A of the cylinder 108 at six or more corners instead of being in contact with the inner peripheral surface 108A of the cylinder 108 over the entire region thereof.

The frequency characteristics of the cylinder 108 in the cases where the support members 116, 136, and 156 according to the first to third examples and the support member 200 according to the first comparative example are supported in the cylinder 108 and in the case where no support member is used are analyzed by the finite element method.

Figure 11:
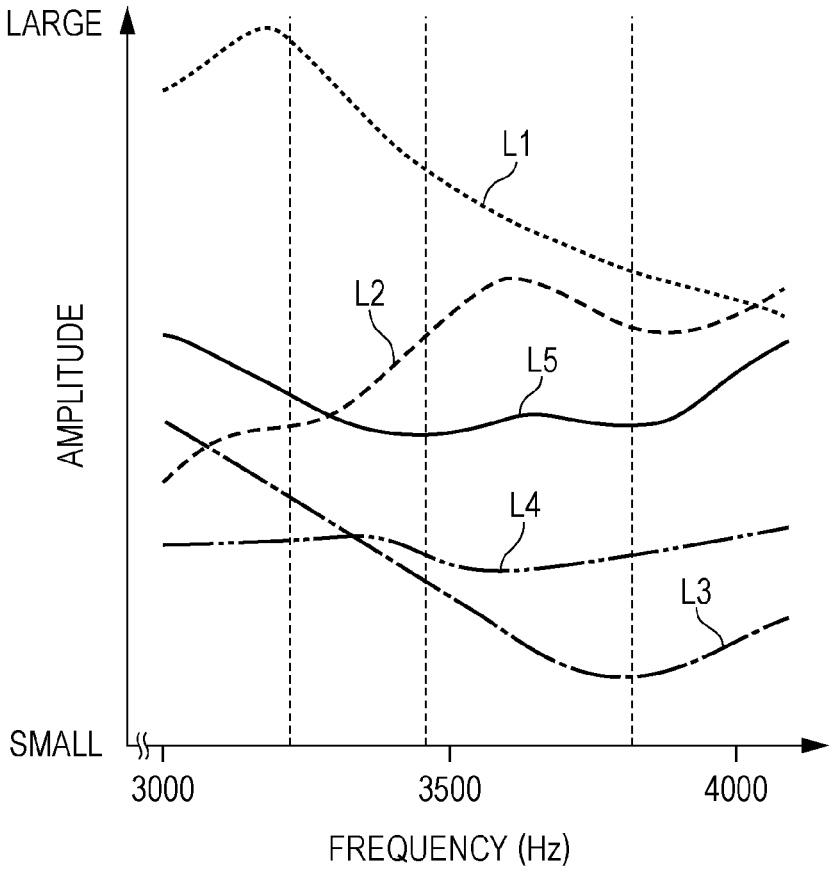
FIG. 11 is a graph showing the frequency characteristics of the cylinder in the case where the support members according to the first to third examples of the exemplary embodiment of the present invention are supported by the cylinder, and the frequency characteristics of the cylinder in the case where support members according to comparative examples are supported by the cylinder.

In the graph of FIG. 11, the horizontal axis represents the frequency of the cylinder 108, and the vertical axis represents the amplitude of the cylinder 108.

In the graph, the dotted line L1 shows the case in which no support member is used, the dashed line L2 shows the case in which the support member 200 according to the first comparative example is used, the one-dot chain line L3 shows the case in which the support member 116 according to the first example is used, the two-dot chain line L4 shows the case in which the support member 136 according to the second example is used, and the solid line L5 shows the case in which the support member 156 according to the third example is used.

When the cylinder 108 vibrates at a frequency of 3500 to 4000 Hz, a sound that makes the user feel uncomfortable is generated.

As is clear from the graph of FIG. 11, when the frequency of the cylinder 108 is in the range of 3500 to 4000 Hz, the amplitude of the cylinder 108 is smaller in the cases where the support members 116, 136, and 156 according to the first to third examples are used than in the case where no support member is used and in the case where the support member 200 according to the first comparative example is used.

SUMMARY

As described above, when the support members 116, 136, and 156 according to the first to third examples are used, compared to the case in which the support member 200 having a C-shaped cross section is used, vibration of the cylinder 108 may be reduced.

When the support member 116 according to the first example is used, since the corners of the projections 118, 120, 122, and 124 are brought into contact with the inner peripheral surface 108A of the cylinder 108, unlike the case where the top surfaces of the projections are brought into contact with the inner peripheral surface 108A, the positions at which the support member 116 is in contact with the inner peripheral surface 108A of the cylinder 108 do not easily vary. This also applies to the support members 136 and 156.

Since the vibration of the cylinder 108 is reduced, the sound generated by the vibration of the cylinder 108 is also reduced.

When the support members 116, 136, and 156 according to the first to third examples are used, compared to the case in which the support member 200 having a C-shaped cross section is used, deformation of the cross sectional shape of the cylinder 108 may be reduced.

When the vibration of the cylinder 108 is reduced, the density uniformity of the toner image formed on the image carrier 56 may be increased.

When the density uniformity of the toner image on the image carrier 56 is increased, the density uniformity of the image output by the image forming apparatus 10 is also increased.

Although a specific exemplary embodiment of the present invention has been described in detail, the present invention is not limited to this, and it is obvious to a person skilled in the art that various exemplary embodiments are possible within the scope of the present invention. For example, in the above-described embodiment, the groove 116B is formed in each of the outer peripheral surfaces 116D, 136D, and 156D of the support members 116, 136, and 156. However, the groove 116B may instead be formed in the inner peripheral surface.

In addition, in the above-described exemplary embodiment, the corners 118D, 118E, 120D, and 120E are symmetrical to the corners 122D, 122E, 124D, and 124E, respectively, with respect to the straight line E1, the corners 138D, 138E, 140D, and 140E are symmetrical to the corners 142D, 142E, 144D, and 144E, respectively, with respect to the straight line E1, and the corners 158D, 160D, and 160E are symmetrical to the corner 162D, 164D, and 164E, respectively, with respect to the straight line E1 when viewed in the depth direction of the apparatus. However, the present invention is not limited to this as long as the corners are symmetrical (in a positional relationship such that corresponding portions face each other).

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A support member supported in a cylinder included in an image carrier, the support member comprising:

six or more contact portions that are arranged in a circumferential direction of the cylinder with spaces therebetween and that are in contact with an inner peripheral surface of the cylinder, a projection that projects outwardly from an outer surface of the support member and toward the inner peripheral surface of the cylinder and that has corners at both ends of the projection in the circumferential direction when viewed in the axial direction, wherein at least some of the contact portions are composed of the corners, wherein the support member is arc-shaped and has a gap at a certain position in the circumferential direction, the gap extending in an axial direction of the cylinder, wherein, in a state in which the support member is supported in the cylinder, a groove that extends in the axial direction is formed in the support member such that the groove and the gap are on opposite sides of a center of the cylinder when viewed in the axial direction, wherein, in the state in which the support member is supported in the cylinder, the contact portions are symmetrical with respect to a straight line that passes through a center of the gap and a center of the cylinder when viewed in the axial direction, wherein, in the state in which the support member is supported in the cylinder, of the contact portions that are on one side of the straight line when viewed in the axial direction, two contact portions that are farthest from each other are separated from each other by approximately 90 degrees or more in the circumferential direction, and two contact portions that are adjacent to each other are separated from each other by approximately 20 degrees or more in the circumferential direction, wherein the projection comprises a first flat surface extending between a first pair of the corners, wherein a second projection comprises a second flat surface extending between a second pair of the corners, and wherein a corner of the first pair of the corners is a corner of the second pair of the corners.

2. An image carrier comprising:

a cylinder that has a cylindrical shape and carries an image on a surface of the cylinder; and the support member according to claim 1 that is supported in the cylinder.

3. An image carrier comprising:

a cylinder that has a cylindrical shape and carries an image on a surface of the cylinder; and the support member according to claim 1 that is supported in the cylinder.

4. An image forming apparatus comprising:

the image carrier according to claim 2;

a charging device that charges a surface of the image carrier;

an exposure device that irradiates the charged surface of the image carrier with light to form an electrostatic latent image;

a developing device that develops the electrostatic latent image formed on the surface of the image carrier into a toner image; and a transfer device that transfers the toner image onto a recording medium.

5. An image forming apparatus comprising:

the image carrier according to claim 3;

a charging device that charges a surface of the image carrier;

an exposure device that irradiates the charged surface of the image carrier with light to form an electrostatic latent image;

a developing device that develops the electrostatic latent image formed on the surface of the image carrier into a toner image; and a transfer device that transfers the toner image onto a recording medium.

6. The support member according to claim 1, wherein among the contact portions and viewed in the axial direction, a first contact portion is closest to a second contact portion, wherein among the contact portions and viewed in the axial direction, a third contact portion is closest to a fourth contact portion, and wherein a distance between the first contact portion and the second contact portion is unequal to a distance between the third contact portion and the fourth contact portion.

* * * * *